US006006413A

United States Patent [19]

Farley

[11] Patent Number: 6,006,413

[45] Date of Patent: Dec. 28, 1999

[54] METHOD FOR MAKING NAIL FILES

[76] Inventor: Brent L. Farley, 4213 Connecticut Ave., Baltimore, Md. 21229

[21] Appl. No.: 08/806,564

[22] Filed: Feb. 25, 1997

Related U.S. Application Data

[60] Provisional application No. 60/012,487, Feb. 29, 1996.

[51] Int. Cl.[6] ..... B29C 37/02; A45D 29/04

[52] U.S. Cl. ..... 29/459; 29/417; 132/76.4; 264/131; 264/138; 264/162; 264/293

[58] Field of Search ..... 264/131, 177.1, 264/138, 150, 162, 293; 132/76.4, 75.6, 73; 29/417, 459; 76/101.1

[56] References Cited

U.S. PATENT DOCUMENTS

| | | | |
|---|---|---|---|
| D. 116,216 | 8/1939 | Brekke | 132/75.6 |
| 587,243 | 7/1897 | Sloan | 132/75.6 |
| 1,665,710 | 5/1928 | Lucas et al. | 132/76.4 |
| 1,743,010 | 1/1930 | Wilmot | 132/75.6 |
| 2,557,175 | 6/1951 | Cortes | 132/76.4 |
| 2,672,148 | 3/1954 | Madden | 132/76.4 |
| 2,838,057 | 6/1958 | Smith | 132/76.4 |
| 3,809,101 | 5/1974 | Shimizu | 132/76.4 |
| 4,292,987 | 10/1981 | Alley | 132/76.4 |
| 4,952,360 | 8/1990 | Gibbon | 264/150 |
| 5,588,453 | 12/1996 | Fraysher | 132/76.4 |
| 5,899,210 | 5/1999 | Letherby et al. | 132/76.4 |

*Primary Examiner*—Jan H. Silbaugh
*Assistant Examiner*—Dae Young Lee
*Attorney, Agent, or Firm*—Richard L. Huff

[57] ABSTRACT

Nail files are made in a manner which permits ease of dispensing. A tube is continuously fed into a milling machine where grooves are formed in predetermined segments of the tube. These grooves are roughened by adhesively applying abrasive particles or by milling the groove surfaces. The tubes are stamped so as to form alternating long grooved areas and short smooth areas. The thus-prepared tubes are divided into sections of desired lengths containing a plurality of nail files which may be easily detached from the remainder of the files in the section. Another method comprises providing a solid or hollow rod which has any of a variety of geometric cross-sections, providing the rod with grooves having varying sizes, roughening the surfaces of the grooves as above, and weakening the rods at predetermined lengths to produce sections containing a series of easily detached segments. The hollow files may be fitted with closures at each end. At least one of these closures is removable and replaceable. In this way, the hollow portion may be used for carrying additional manicure equipment. Another alternative is the preparation of a series of individual nail files. Each file has a rough upper surface, a smooth lower surface, and a ring-like opening attached to the lower surface. These files are attached to each other in a series by light adhesive bonding of one lower surface to the next adjacent lower surface. Extremely little waste is produced by the methods of manufacture of the present invention.

5 Claims, 10 Drawing Sheets

METHOD FOR MAKING NAIL FILES

CROSS-REFERENCE TO RELATED APPLICATIONS

This application claims the benefit of U.S. Provisional Application 60/012,487, filed Feb. 29, 1996.

BACKGROUND OF THE INVENTION

1. Field of the Invention

This invention is concerned with the manufacture of nail files having grooves containing roughened sides.

2. Description of the Related Art

Manicure instruments including nail files are well known. U.S. Pat. No. 1,473,717 to Atkinson, U.S. Pat. No. 1,529,321 to Pearson, and U.S. Pat. No. 1,597,589 to Ferrari are examples of such instruments which may be worn as rings. U.S. Pat. No. Des. 58,210 to Beauregard, U.S. Pat. No. Des. 290,533 to Kadaja, U.S. Pat. No. 1,707,879 to Schwartzman, U.S. Pat. No. 2,019,580 to Poux, U.S. Pat. No. 2,573,310 to Collier, U.S. Pat. No. 2,233,438 to Troya, U.S. Pat. No. 2,566,688 to West, and U.S. Pat. No. 4,292,987 to Alley describe nail files having grooves which contain filing surfaces. It is evident from an examination of these patents that the devices either could not be made from a single piece of stock material, or if such a type of manufacture was attempted, a large quantity of waste would be produced. Additionally, these products must be dispensed as units.

SUMMARY OF THE INVENTION

It is an object of this invention to introduce methods of manufacturing nail files which demonstrate at least one of the desirable qualities of permitting continuous manufacture from a single source of stock material, the absence of waste material, and the preparation of a plurality of units in a convenient assembly wherein one unit may be easily separated.

In one embodiment of the present invention, a single tube of plastic or metal is passed through a milling machine which prepares a plurality of grooves of selected lengths along the top and bottom outer surfaces of the tube. These grooves are provided with a roughened surface in the milling machine. Preferably the preparation of the grooves and the roughened surfaces occurs as a single step. The tubes are then stamped to provide outlines of segments which can be easily snapped off to provide a series of easily transported segments or a single segment ready for use. In a second embodiment of the present invention, a single hollow or solid plastic or metal rod having any of several geometric shapes is passed through a milling machine where grooves having roughened surfaces are applied to the surfaces along the entire lengths of the surfaces. The rods are stamped so as to allow for the easy separation of a series of segments or a single segment. In a third embodiment of this invention, a solid bar of plastic or metal is passed through a machine to provide the top surface with a roughened surface and to cut the bar into uniform predetermined sections. The roughened surfaces are achieved by milling or by adhesively applying abrasive particles. Horseshoe-shaped open holders are attached to the lower surfaces of the thus-formed sections. These sections are then aligned bottom surface to bottom surface and held together by a weak adhesive which is sufficient to prevent accidental separation, but capable of being loosened by a sharp snapping motion. In all of these methods, there is no waste produced, which is an improvement which is not suggested by the prior art. The segments of nail files may be carried by an individual as a series of segments or as a single segment, thus allowing for versatility in marketing and use. Grooves may be of different sizes so as to have a varying range of utility.

DESCRIPTION OF THE PREFERRED EMBODIMENTS

Figure 1:
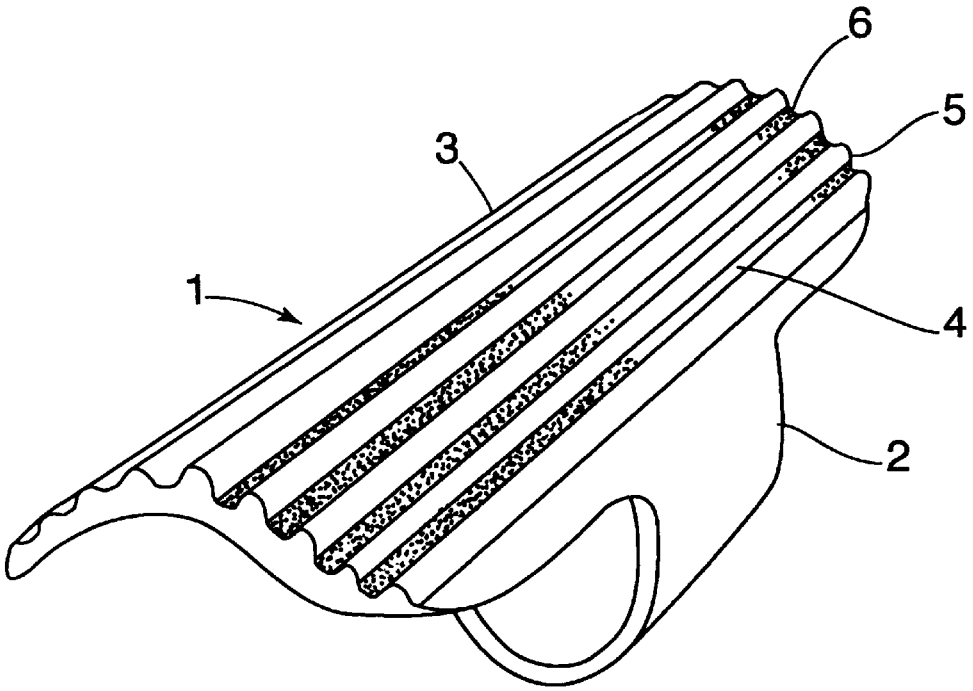
FIG. 1 is an elevational perspective view of a ring nail file prepared according to the first embodiment of this invention.
Figure 2:
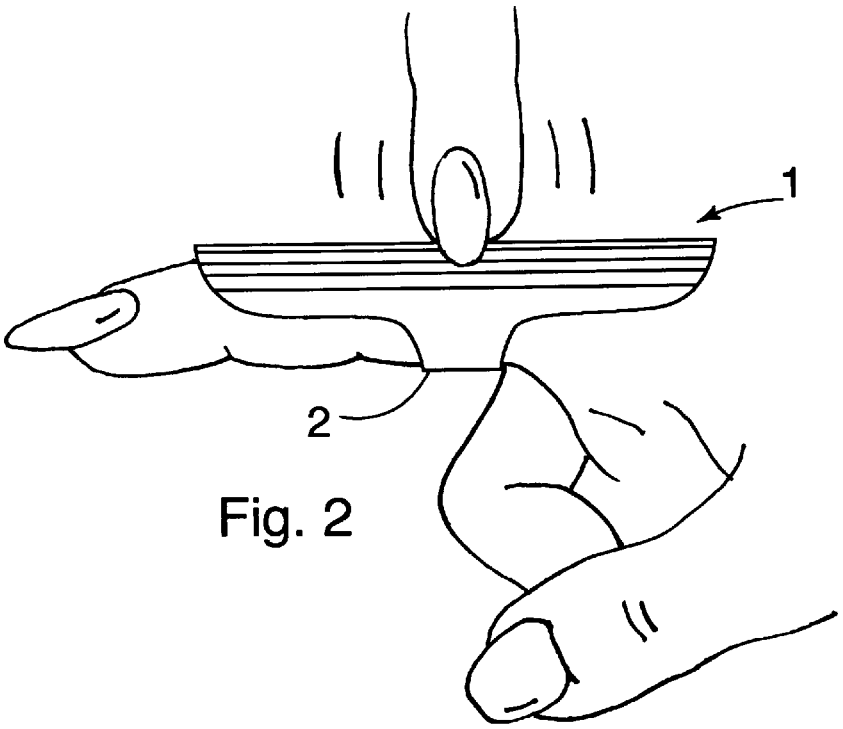
FIG. 2 is a side elevational view of a ring nail file prepared according to the first embodiment of this invention in use.
Figure 3:
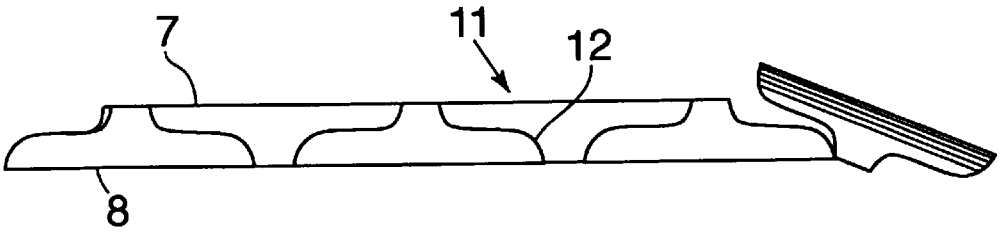
FIG. 3 is a side elevational view of connected segments of ring nail files prepared according to the first embodiment of this invention.
Figure 4:
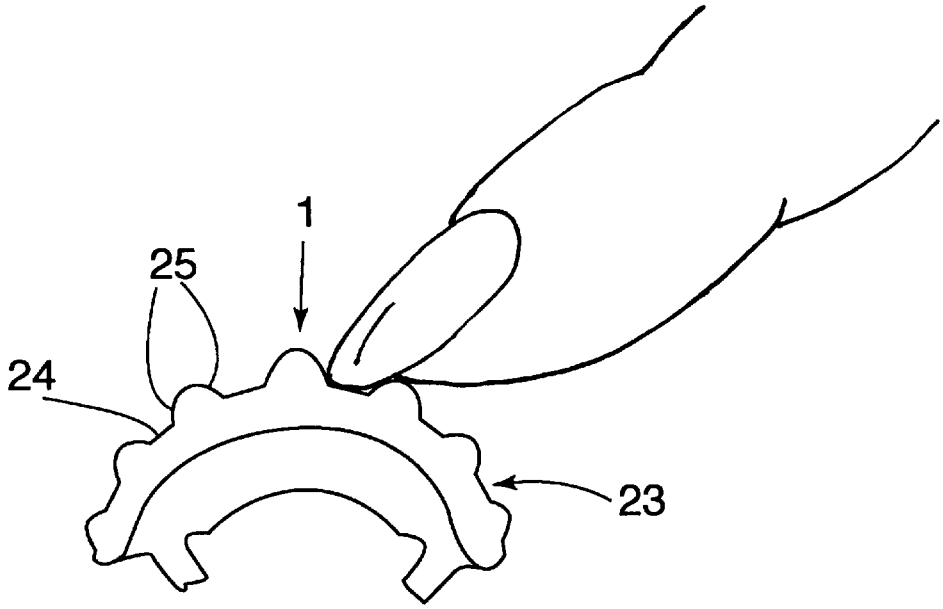
FIG. 4 is and end elevational view of a ring nail file prepared according to the first embodiment of this invention in use.
Figure 5:
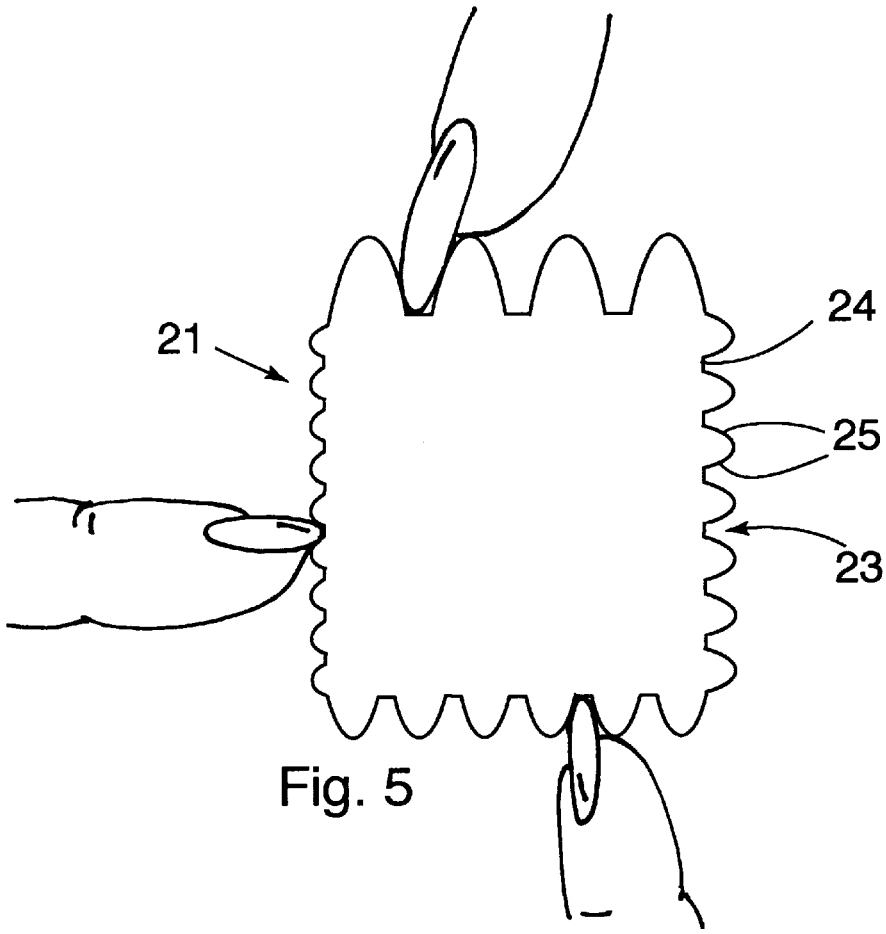
FIG. 5 is an end view of a nail file prepared according to the second embodiment of this invention in use.
Figure 6:
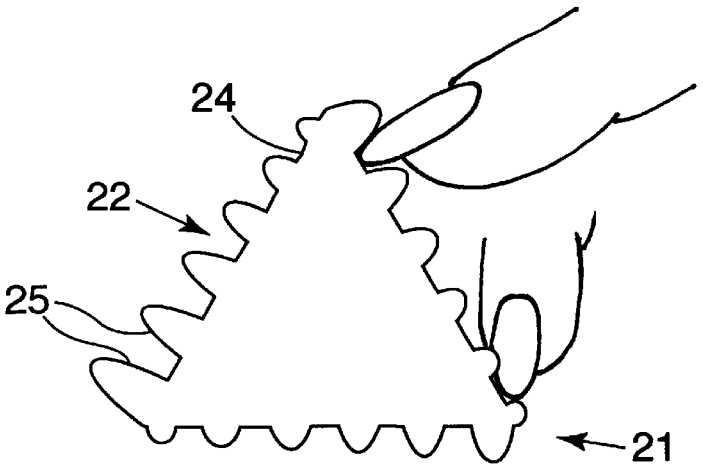
FIG. 6 is an end view of another nail file prepared according to the second embodiment of this invention in use.
Figure 7:
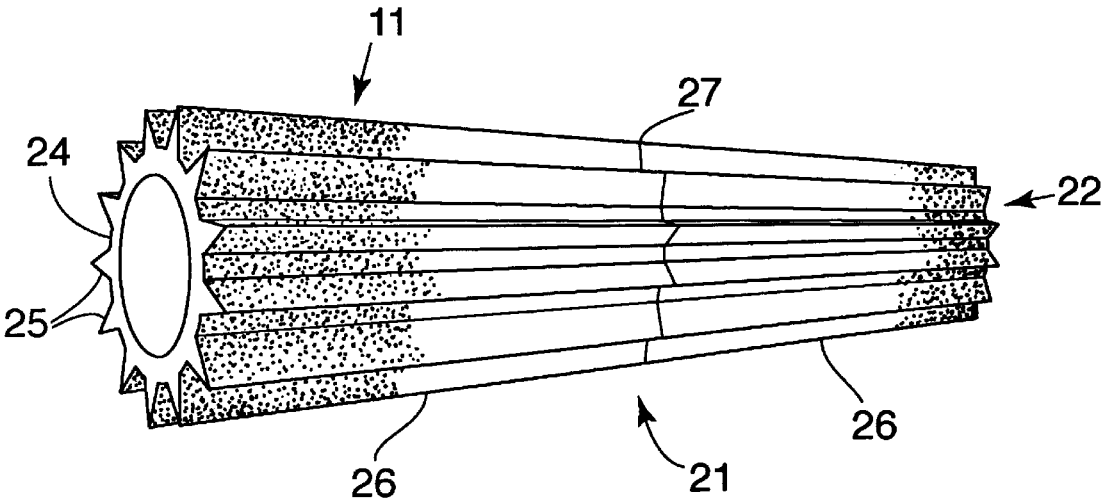
FIG. 7 is an elevational perspective view of a series of segments of another nail file prepared according to the second embodiment of this invention.
Figure 8:
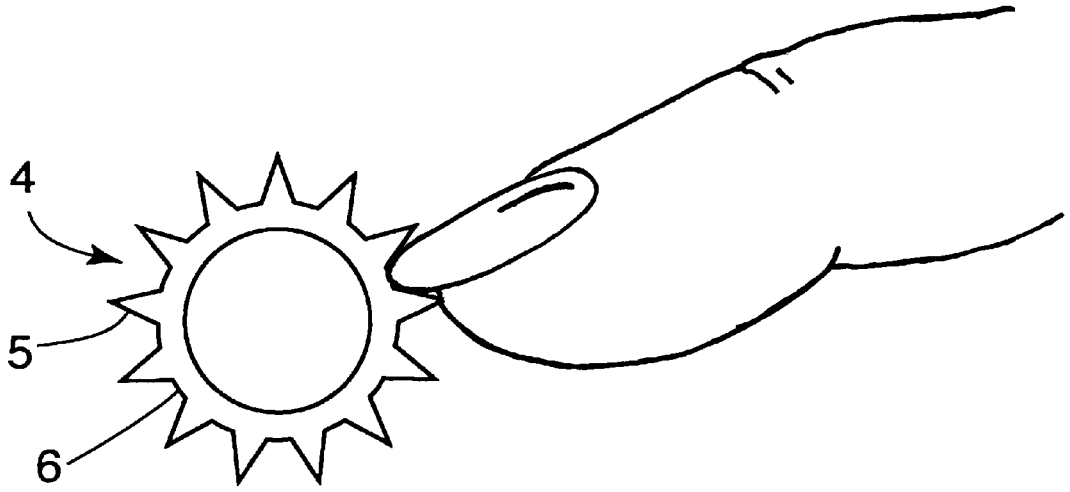
FIG. 8 is an elevational end view of a nail file prepared according to the second embodiment of this invention in use.
Figure 9:
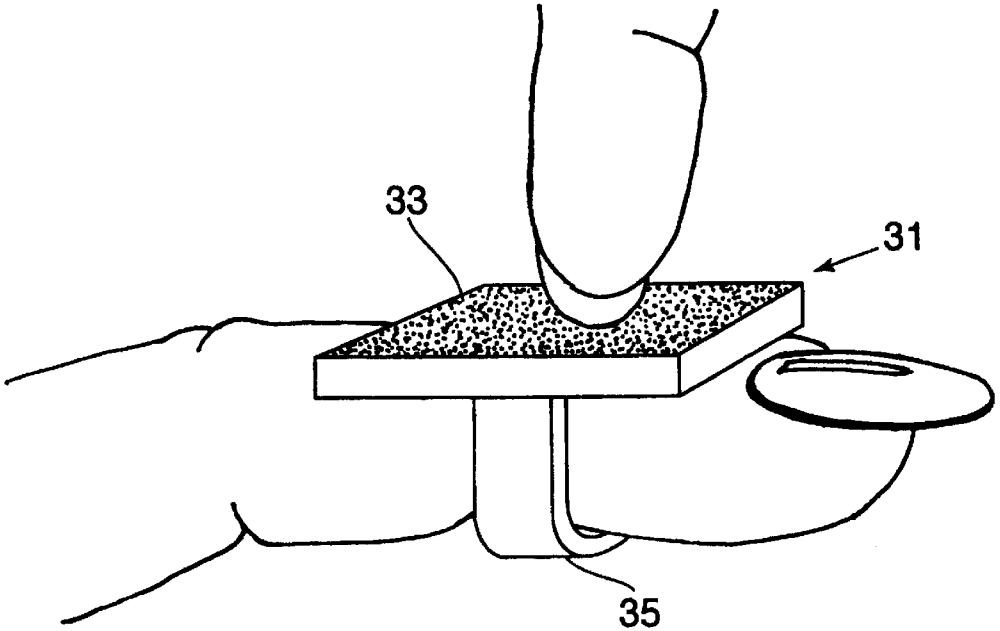
FIG. 9 is an elevational perspective view of a nail file prepared according to the third embodiment of this invention in use.
Figure 10:
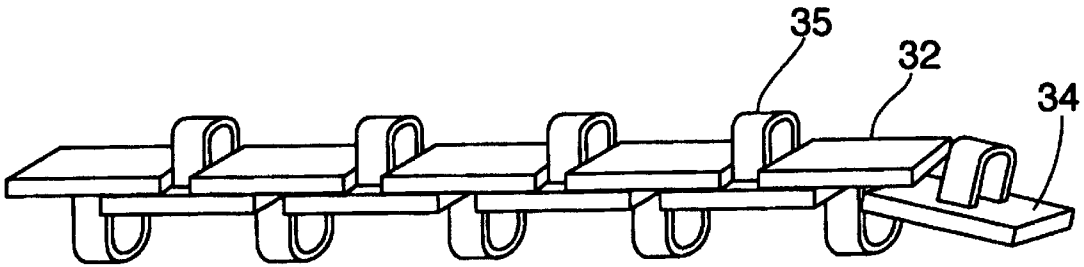
FIG. 10 is an elevational perspective view of a series of segments of nail files prepared according to the third embodiment of the present invention.
Figure 11:
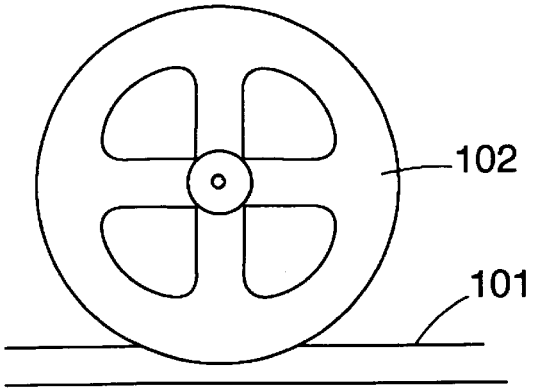
FIG. 11 is a side elevational view showing a milling wheel in position over a rod which is to be made into nail files.
Figure 12:
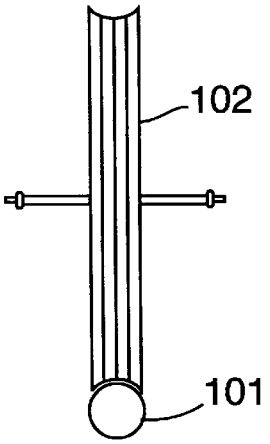
FIG. 12 is an end elevational view showing a milling wheel in position (slightly removed for clarity) over a rod which is to be made into nail files.

In one preferred embodiment of the present invention, a ring nail file 1 is manufactured. This nail file 1 is circular in cross-section. From the side, this nail file 1 has a narrow, smooth, centrally located lower band 2 and a broad upper section 3 suitable for use as a nail file. The upper section 3 contains a plurality of grooves 4 containing side surfaces 5 and bottom surfaces 6. At least the side surfaces 5 of these grooves 4 are roughened so as to form a surface capable of shaping nails.

In preparing the file 1 of this embodiment, a cylindrical metal or plastic tube 101 is provided. This may be in the form of a tube 101 of a predetermined length or the tube 101 may be endless, such as the product of an extrusion process.

The material is not critical. Known plastic materials capable of being milled and retaining their shape are suitable for this invention. Stainless steel is the preferred metal.

The tube 101 is passed through a milling machine. The milling machine produces grooves 4 in the outer surface of the top 7 and bottom 8 of the tube 101. The surface covered by grooves 4 on the top 7 is equal to the surface covered by grooves 4 on the bottom 8. This can be accomplished by a milling wheel 102 having peaks 103 and valleys 104 over predetermined portions of its surface while the remainder of its surface is smooth. When applied with pressure to the tube 101, grooves 4 in the tube 101 corresponding to the peaks 103 in the milling wheel 102 are produced The area of the tube 101 covered by grooves 4 is not critical, but from one-quarter to one-third of the circumference is preferred for each of the top 7 and bottom 8 surfaces. The milling wheel 102 contains alternating areas which contain peaks 103 and valleys 104 and areas which are smooth. In this way the resulting tube 101 contains grooves 4 which are not continuous. The milling machine contains a milling wheel 102 for contacting and milling the bottom of the tube 101 and another milling wheel 102 for contacting and milling the top of the tube 101. In this way, the milling process results in alternating grooved and smooth surfaces on both the top 7 and bottom 8. While not critical, it is preferred that the length of a grooved segment be approximately ten times the length of a smooth segment.

Figure 13:
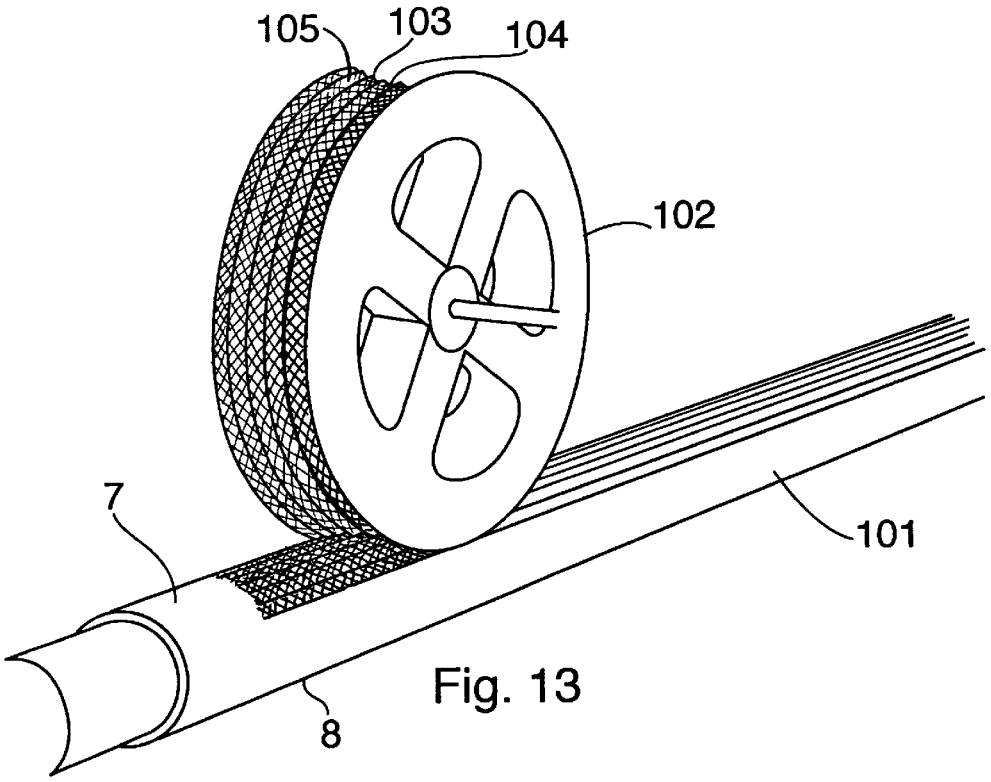
FIG. 13 is an elevational perspective view of a milling wheel in position to apply roughened surfaces to grooves
Figure 14:
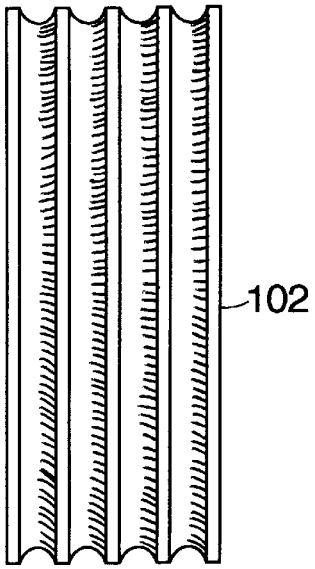
FIGS. 14–16 are elevational views of machine wheels which introduce roughened surfaces and grooves of different shapes and sizes into rods.
Figure 15:
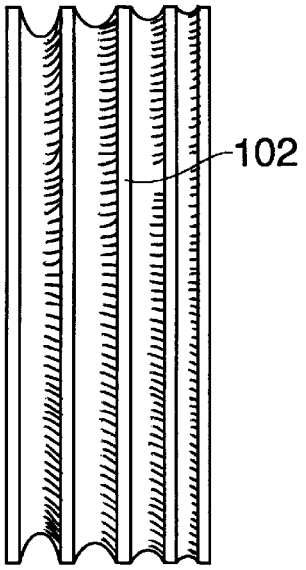
Figure 16:
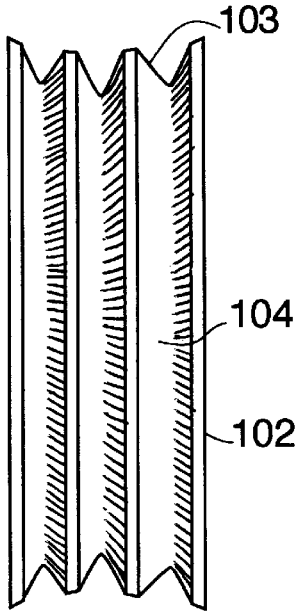
Figure 17:
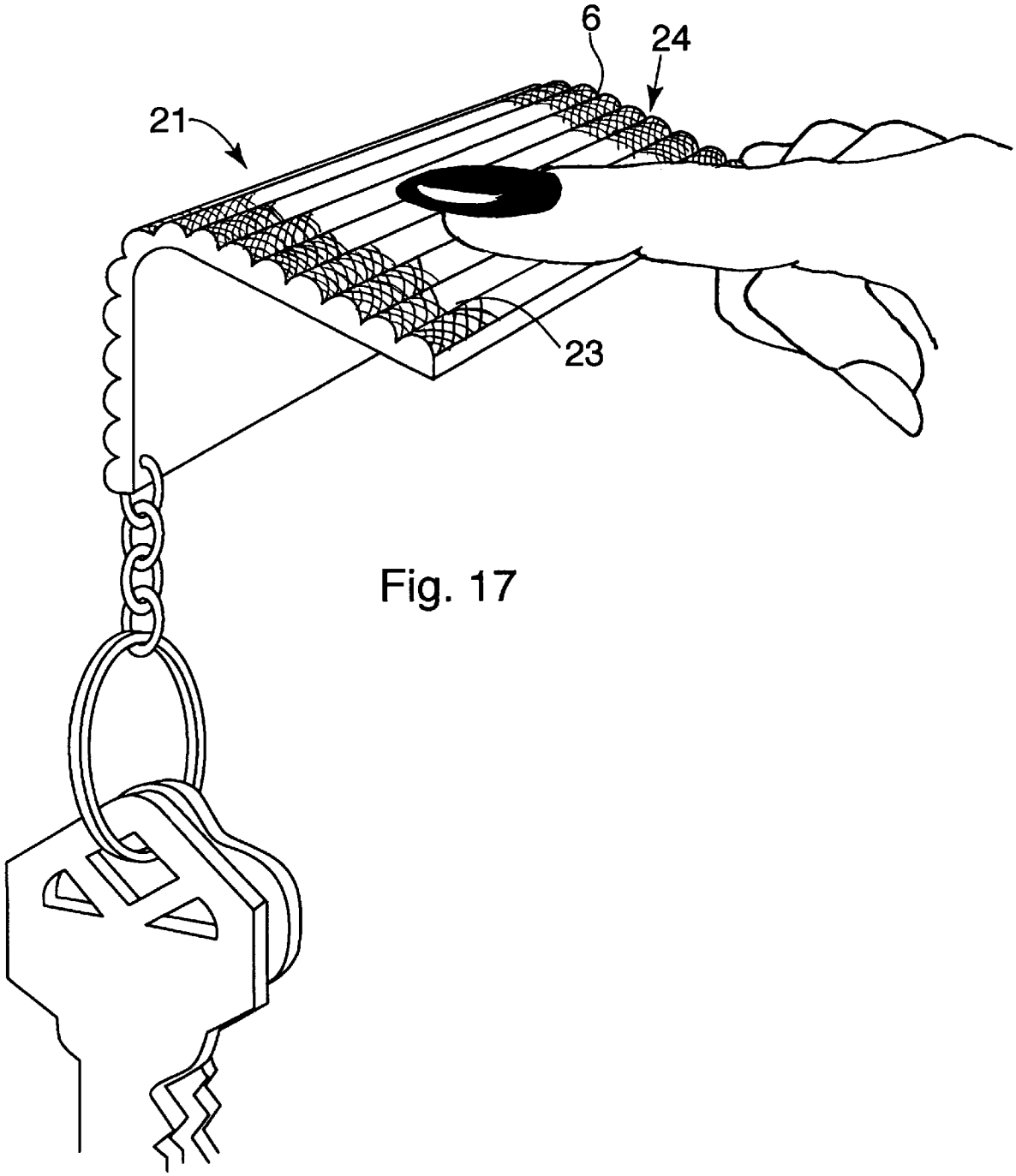
FIG. 17 is an elevational perspective view of an "L"-shaped nail file according to this invention
Figure 18:
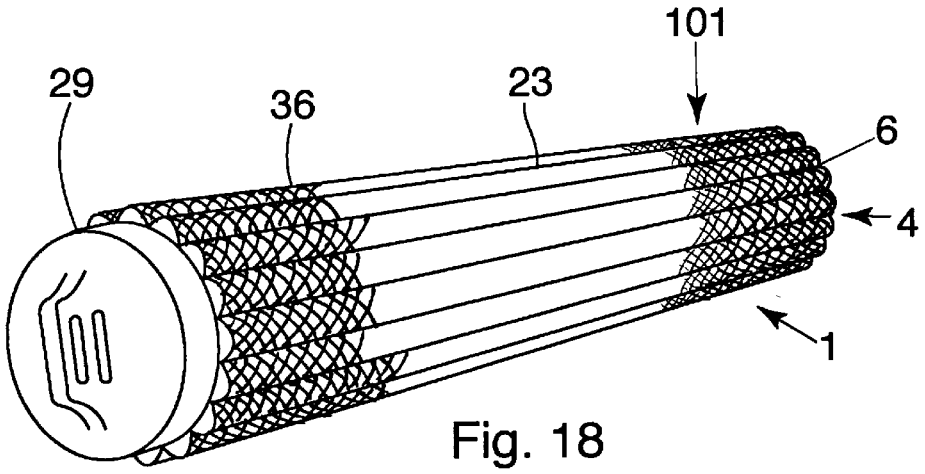
FIG. 18 is an elevational perspective view of a hollow nail file having a cover.
Figure 19:
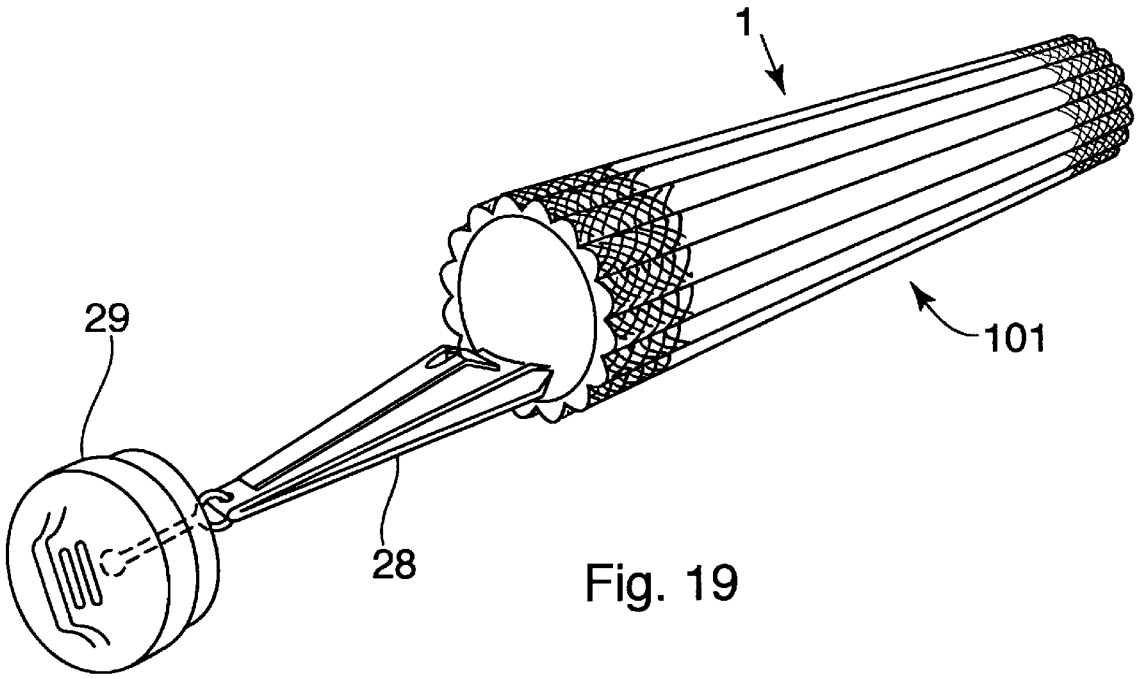
FIG. 19 is an elevational perspective view of the nail file of FIG. 19 containing additional manicure equipment.

The grooves 4 have side surfaces 5 and bottom surfaces 6. In the milling machine, at least the side surfaces 5 of the grooves 4 are provided with a roughened surface 9. This may be accomplished by stamping the grooves 4 by the machine. This may be accomplished by applying a mixture of adhesive and abrasive particles to the grooves 4. Alternatively, as shown in FIG. 13, the milling wheel 102 contains peaks 103 and valleys 104 and roughened surfaces 105. Treatment of the tube 101 with such a milling wheel 102 results in a tube 10 having roughened grooves 4. The grooves 4 may be of the same width or have different widths.

The resulting tubes 10 which have top 7 and bottom 8 alternating grooved and smooth sections are then stamped to produce in outline, mirror image top and bottom segments 11 wherein each segment 11 has a long grooved section and a centrally located smooth section connecting the sides of the grooved section. The stamping process is performed by a milling apparatus which is well known in the art for weakening articles at prespecified areas. The stamping process is carried with insufficient force to separate the segments, but with sufficient force to weaken the abutment lines 12 between the segments 11. A series of segments 11 is then separated from the remainder of the tube 10 by applying an upward or downward snapping force. A series of a predetermined number of segments is then inspected and packaged. Since the top and bottom segments 11 are mirror images, each top segment 11 nests perfectly with the two abutting bottom segments 11, and no waste is produced except for the inconsequential amount at the beginning of the process.

The thus-prepared segment 1 is used as a ring to be held in place on one hand while nails of the other hand are shaped by moving the nails along the sides or bottoms of grooves.

In a second embodiment of the present invention, a nail file 21 is prepared using a rod 106 or tube 101 of plastic or metal material as the starting material. The rod 106 or tube 101 may be of a predetermined length or of endless length as a result of an extrusion process. The rod 106 may be in the form of a hollow tube or a solid bar having an axis 22 and any of a variety of geometric cross-sections. Preferred cross-sectional shapes are triangle, square, and circle. "L"-shaped sections are particularly preferred.

Grooves 23 having different sizes are put into the outer surfaces of the rod 106 by the milling wheel 102. Each groove 23 has a bottom 24 and two sides 25 and has a uniform width and depth throughout the length of the rod 106. The grooves 23 may be imparted during an extrusion process or may be imparted by a milling wheel 102 in the milling machine. Roughening is provided to at least the sides 25 of the grooves 23. This is done by a milling wheel 102 having roughened surfaces 105 milling in this area or by applying a combination of adhesive and abrasive particles.

Following the formation and roughening of the grooves 23, the milling machine provides stamping pressure around the rod 106 at predetermined lengths. This stamping process divides the rod into segments 26 of predetermined uniform length. The stamping pressure is not great enough to physically separate the segments, but is sufficient to weaken the abutting lines 27 so as to enable separation by snapping. Machines with this capacity are well known in the art.

Following milling a series of segments 26 is removed, inspected, packaged, and marketed as a series of segments. The user then snaps individual segments 26 from the series and uses that segment to shape nails. This is done by a back and forth curved motion of the nail against a roughened groove 23.

As is clear from the above description, no waste is produced by the production process, a variety of sized and shaped grooves 23 may be produced, and one or several of the files 21 may be purchased by the user.

An extended use of a hollow file as just described is as a carrier for additional manicure equipment 28, such as clipping scissors, devices for cleaning under nails, and devices for pushing back cuticles. Such a device contains a hollow central portion and has a longitudinal axis. The outer surface has grooves 23 containing roughened surfaces 36. Each end of the carrier has a closure 29, at least one of which may be removed and replaced. Snap-in closures are preferred for this purpose. The material used for these closures is preferably pliable in nature, such as vinyl plastic. The hollow central portion serves as a carrier for the additional manicure equipment. While the cross-sectional shape is not critical, carriers having a circular cross-section are preferred.

In a third embodiment of the present invention, a file 31 comprising a segment 32 having a roughened upper surface 33, a smooth lower surface 34, and a horseshoe-shaped attachment 35 on the lower surface 34 for forming an opening for a holding finger is prepared. A flat bar of metal or plastic having a lower surface 34 and an upper surface 33 is introduced into the manufacturing machine wherein the upper surface 33 is provided with a roughened surface 36. This may be accomplished by stamping the upper surface 33 so as to provide a hard roughened surface 36 or applying a mixture of adhesive and abrasive particles. The treated bar is then divided into segments 32 by cutting or stamping. These blocks are conveniently small in size. Although size is not critical, a block having side dimensions of approximately 5 cm by 2 cm is preferred. A horseshoe-shaped band 35 is attached to the lower surface 34 of the segment 32 to form an opening which fits over a finger to hold the segment 32 into place during use. This attachment 35 may be in any convenient manner. Spot welding and application of adhesive are preferred methods. Following construction, the segments 32 are aligned in series, lower surface 34 abutting lower surface 34. An adhesive which is strong enough to prevent the accidental separation of segments of the series, but weak enough to allow separation upon the application of a snapping motion is applied between the several lower surfaces 34. The series of segments 32 may be broken into convenient lengths for packaging and selling. The end user may easily separate a segment 32 from the remainder of a series.

It will be appreciated that no waste is generated during the manufacture of the nail files 31 of this embodiment.

The several embodiments of the invention are useful in that the amount of wasted stock products are dramatically reduced or entirely eliminated; a series of nail files may be manufactured, packaged, and displayed for ease of selling; a wide variety of materials, shapes and sizes of products are useful; and a wide variety of sizes and shapes of grooves is available.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claimed invention.

I claim:

1. A method of making a nail file which comprises:

A) providing a cylindrical hallow metal or plastic tube having an outer surface;

B) passing the tube through a milling machine wherein grooves of predetermined length, width, and depth are milled into preselected portions of the outer surface, which grooves have side surfaces and bottom surfaces;

C) providing at least the side surfaces of the grooves with rough surfaces;

D) stamping the thus-milled tube so as to form overlapping individual segments, each segment being capable of being snapped off of the remainder of the tube and each segment having a relatively long milled area which serves as a file and a relatively short unmilled area which serves as a ring for attachment to a finger.

2. The method of claim 1, wherein the grooves are provided with a rough surface by adhesively applying abrasive particles to the groove surfaces.

3. The method of claim 1, wherein the grooves are provided with a rough surface by stamping the groove surfaces.

4. The method of claim 1, wherein the tube is plastic.

5. The method of claim 1, wherein the tube is metal.

* * * * *